US005329873A

United States Patent [19]

Tiballi

[11] Patent Number: 5,329,873

[45] Date of Patent: Jul. 19, 1994

[54] EXTENDABLE PERSONAL DIVE FLAG

[76] Inventor: Nancy Tiballi, 3789 Golden Point Dr., North Miami Beach, Fla. 33180

[21] Appl. No.: 144,824

[22] Filed: Nov. 1, 1993

[51] Int. Cl.[5] ..... G09F 17/00; G09F 21/02; A62B 37/00

[52] U.S. Cl. ..... 116/173; 116/209; 40/586; 40/610; 441/80

[58] Field of Search ..... 116/209, 173; 135/74; 40/586, 610; 441/11, 80, 89

[56] References Cited

U.S. PATENT DOCUMENTS

| | | | |
|---|---|---|---|
| Re. 28,067 | 7/1974 | Hyman | 135/74 |
| 1,288,060 | 12/1918 | Le Duc | 116/173 |
| 1,484,485 | 2/1924 | Frear | 116/173 |
| 3,105,459 | 10/1963 | Conn | 116/209 |
| 3,117,549 | 1/1964 | Ripepe | 116/173 |
| 5,114,369 | 5/1992 | Coffey | 441/11 |
| 5,179,907 | 1/1993 | Galbraith | 116/209 |

FOREIGN PATENT DOCUMENTS

| | | | |
|---|---|---|---|
| 0013247 | of 1900 | United Kingdom | 116/173 |
| 0021645 | of 1907 | United Kingdom | 116/173 |

*Primary Examiner*—William A. Cuchlinski, Jr.
*Assistant Examiner*—Willie Morris Worth
*Attorney, Agent, or Firm*—Malloy & Malloy

[57] ABSTRACT

An extendable, personal dive flag including a plurality of tubular segments, the tubular segments being adapted to be matingly engaged with one another and being interchangeably positionable between an extended, interlocking position so as to form a substantially elongate, easily carryable shaft, and a collapsed, compact position so as to form a substantially small, lightweight, and easily portable bundle. A distal segment of the flag including a warning flag fixedly secured thereto such that the personal dive flag can be extended through the water's surface to signal a diver is approaching before the diver actually arrives at the surface. The personal dive flag is structured to automatically extend from its collapsed, compact position to its extended, interlocking position without requiring extensive manipulation by the diver.

5 Claims, 1 Drawing Sheet

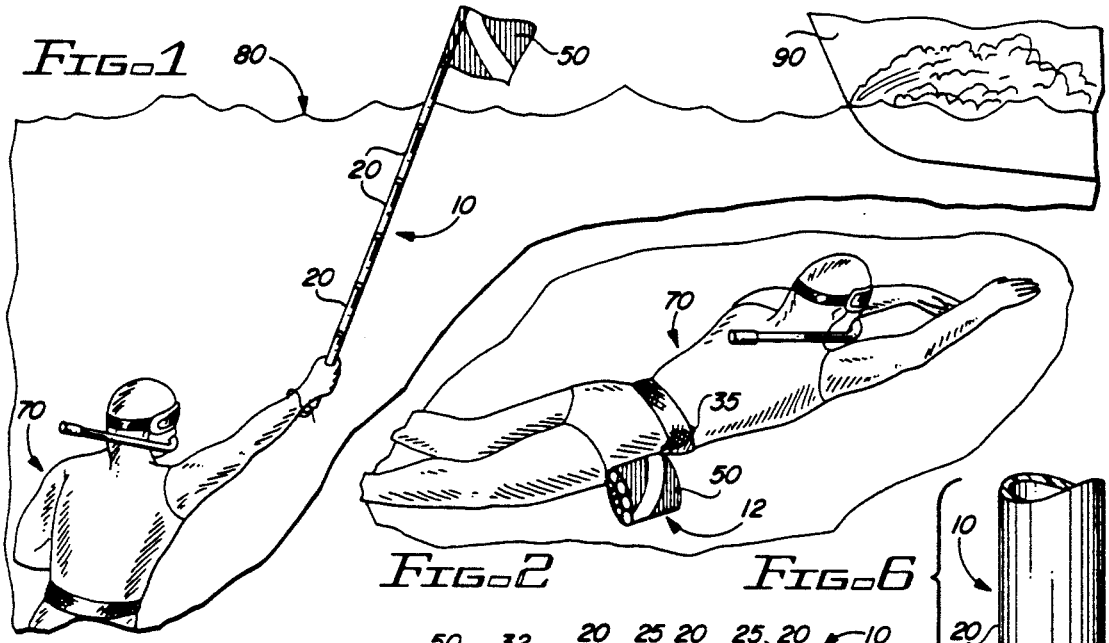
FIG. 1
FIG. 2
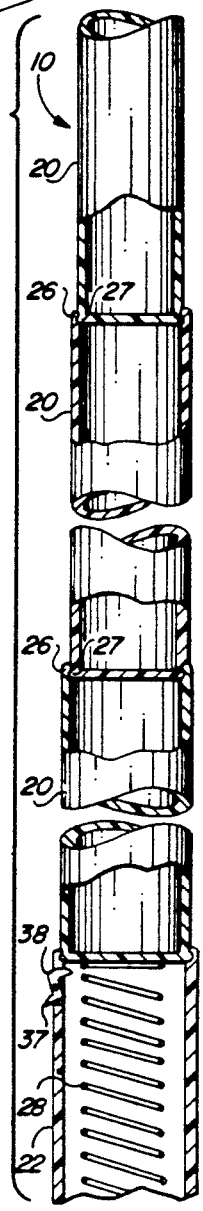
FIG. 6
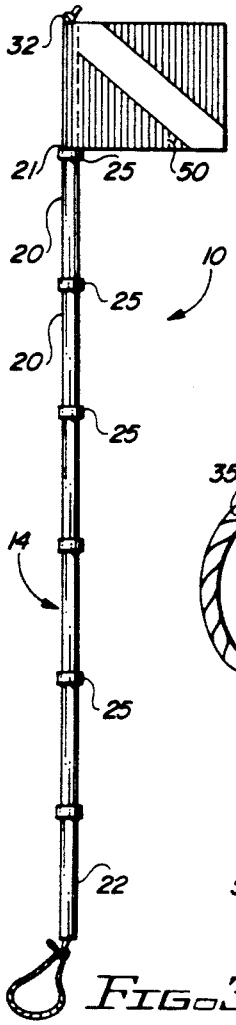
FIG. 3
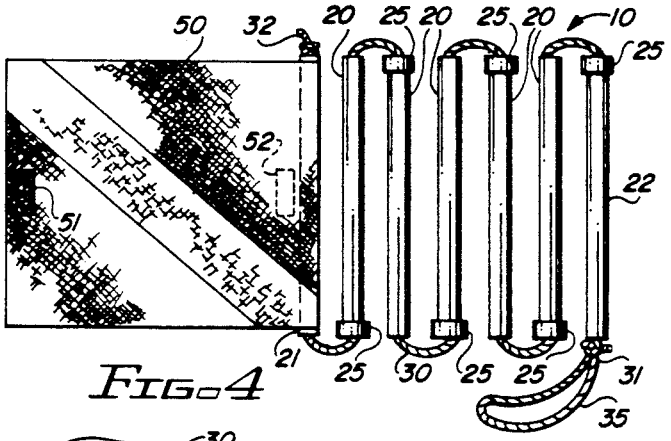
FIG. 4
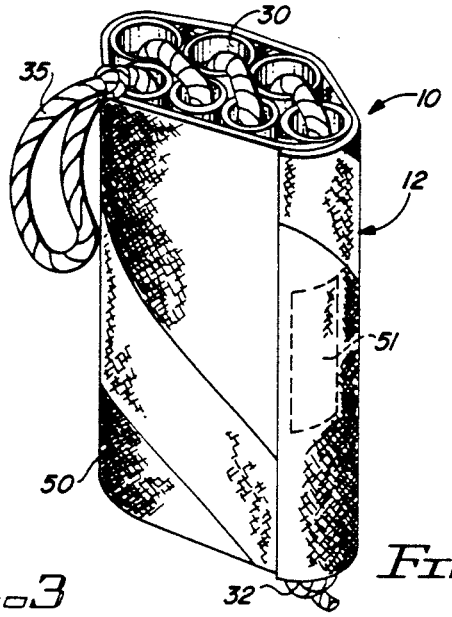
FIG. 5

EXTENDABLE PERSONAL DIVE FLAG

BACKGROUND OF THE INVENTION

1. Field of the Invention

The present invention relates to an extendable personal dive flag to be utilized by scuba divers, skin divers, or snorkelers to enable them to signal to individuals on the water's surface that they are approaching the water's surface, thereby signalling their presence in the water before they surface.

2. Description of the Related Art

It is a general requirement that divers utilize diver down flags in the area of their dive so as to alert boaters or other vehicle users of their presence beneath the surface. Traditionally, the dive flags are extended from the boat of the diver or are placed on buoys which are allowed to float in the area of the dive. With many active divers, however, placing the stationary dive flags is not effective because after extended swimming they may surface in a location far from their original dive sight. A primary reason for this is that divers are generally guided by what they see underwater and it is difficult to keep track of their original dive location when exploring, doing jobs, or otherwise moving around beneath the surface of the water. For these reasons, it would be highly beneficial to provide a personal dive flag which an individual diver can carry with them and utilize to signal their particular location of surfacing.

There are various types of independently floating diver buoys, such as those disclosed in the patents to Mcintyre, U.S. Pat. No. 4,144,606, Handelman, U.S. Pat. No. 3,760,441, and Galbraith, U.S. Pat. No. 5,179,907, which can be broken down into a number of smaller pieces or otherwise collapsed. These buoys, however, which are adapted to be placed in the water so as to float in the area of a dive during the entire dive, are substantially large and could not be carried under water by an individual both due to their size and the inclusion of flotation means whose purpose is to maintain the buoy on the water's surface. Further, and most importantly, when putting together the buoys, a lengthy process of interconnecting segments and attaching pieces must usually be employed, thereby making it a lengthy and arduous process. In addition to the larger dive buoys which are adapted to be deployed in the general area of the dive, there are some devices adapted to be utilized by the individual diver. Such devices include the safety floats recited in the patents to Conn, U.S. Pat. No. 3,105,459 and Weck, U.S. Pat. No. 183,521. Particularly, the safety float of Conn is adapted to be carried by the user and released, preferably on a rope, when the diver is ready to surface, and the float of Weck trails, on a line, behind the diver during the entire dive. Unfortunately, due to various currents and the like, the location of the safety flag may not always be precise. Also, deployment is not facilitated in situations when a diver makes a quick decision to surface because the diver must wait for the buoy to float to the surface by itself while the tie line unwraps.

In addition to those devices adapted specifically for use by divers, other individual signalling flags have been utilized. Such signalling devices include the patents to Precourt, U.S. Pat. No. 3,775,887 and Coffey, U.S. Pat. No. 5,114,369. Both of these devices, however, require manual extension and are not adapted to be sufficiently elongate to enable a diver to signal through the surface of the water before arriving at the water's surface. Particularly, skin divers or snorkelers find themselves returning to the surface at somewhat frequent rates, and often do not approach the surface until they have used up all of their air. For such skin divers and snorkelers, it would be impractical to have a signalling device which they must manually extend, and/or put together, thereby consuming valuable time beneath the surface of the water. Further, many divers collect items such as shells and the like from beneath the surface of the water, or otherwise carry varying implements and tools to be utilized under water. As a result of the numerous tools or items they will carry back to the surface, it would be highly difficult for a diver who at most has one free hand to pause before arriving at the surface of the water, pull out the signalling flag, and manually extend it every time they wish to surface.

For the reasons previously recited, it would be highly beneficial to provide a personal dive flag which can be easily and conveniently carried by a diver and can be quickly and easily extended by a diver when needed. Further, such a flag should be sufficiently elongate to enable the diver to signal above the water's surface even before they are at the water's surface and should be independently carryable so that a diver is not forced to remain within a specific dive area defined by surface buoys. The device of the present invention is such an apparatus which can be used simply and effectively by any diver so as to provide substantially increased safety in all dive situations.

SUMMARY OF THE INVENTION

The present invention relates to an extendable personal dive flag which can be utilized by an individual diver to signal to boaters or other passersby that he/she will be surfacing at a specific location. The personal dive flag includes primarily a plurality of tubular segments. The tubular segments are structured to be matingly engaged with one another and include a proximal segment, a distal segment, and a plurality of middle segments. All of these tubular segments are positionable between an extended interlocking position and a collapsed, compact position. When in the collapsed, compact position, the tubular segments form a substantially small, lightweight, and easily carryable bundle. The bundle is sized so as to be easily and conveniently carried by a diver without taking up too much added space that may be needed for other equipment. When in the extended interlocking position, the tubular segments form a substantially elongate, easily carryable shaft. The shaft is structured so as to allow the diver to swim towards the surface of the water while holding the shaft above him/her. As the diver approaches the surface, the distal segment of the shaft can be extended through the surface of the water before the diver reaches the water surface. Positioned on that distal segment is a warning flag. The warning flag is secured to the distal segment and functions to signal that the diver is surfacing at that location when the distal segment of the shaft is extended through the water. Also included are automatic extension means. The automatic extension means are particularly structured such that when the user, namely the diver, desires and initiates it, the tubular segments will be rapidly and independently positioned in the extended, interlocking position from the collapsed, compact position.

It is a primary object of the present invention to provide a personal dive flag which can be carried by each individual diver and utilized to signal that they are about to surface at a particular location well before they are placed in potential danger at the actual surface of the water.

Still another object of the present invention is to provide a personal dive flag which can be quickly, easily, and automatically extended by the diver such that excess time need not be wasted beneath the water's surface when the diver wants to surface.

Yet another object of the present invention is to provide a personal dive flag which can be quickly and easily extended by the diver without requiring complicated attachment and extension of the dive flag, thereby facilitating its use by a diver carrying other tools or objects when surfacing.

A further object of the present invention is to provide a personal dive flag which when not in use will be sufficiently compact so as to not take up too much space among the diver's gear and equipment.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the personal dive flag in use by a surfacing diver.

FIG. 2 is a perspective view of a diver carrying the extendable personal dive flag of the present invention in its collapsed, compact position.

FIG. 3 is a side view of the first embodiment of the extendable, personal dive flag in its extended, interlocking position.

FIG. 4 is a side view of the first embodiment of the extendable, personal dive flag in a partially collapsed position illustrating the interconnection of the tubular segments.

FIG. 5 is a side view of the first embodiment of the extendable, personal dive flag in its collapsed, compact position.

FIG. 6 is a partial, cross-sectional view of the automatic extension means of a second embodiment of the extendable, personal dive flag.

Like reference numerals refer to like parts throughout the several views of the drawings.

DETAILED DESCRIPTION OF THE PREFERRED EMBODIMENT

As shown throughout the drawings, the present invention is of an extendable, personal dive flag, generally indicated as 10. The personal dive flag 10 includes primarily a plurality of tubular segments 20. The exact number and size of the tubular segments 20 may vary according to the needs of a diver 70, however, the tubular segments will include a proximal segment 22, a distal segment 21, and a plurality of middle segments. Preferably, the tubular segments 20 are substantially small in diameter and each sufficiently short so as to make the dive flag 10 easily portable and carryable. The tubular segments 20 may be formed of any sturdy, yet lightweight material such as PVC to facilitate manufacturing and minimize cost thereof, thereby enabling facilitated extensive use of the safety device. The tubular segments of the dive flag 10 are structured to be matingly engaged with one another. In the preferred embodiment, one end of each of the tubular segments 20 includes a connector piece 25 of an interior diameter slightly larger than an exterior diameter of the tubular segments 20. The connector pieces 25 are disposed such that the narrow end of each tubular segment 20 which does not include a connector piece 25 thereon may be fitted into the connector piece 25 of an adjacent tubular segment 20. The tubular segments 20 are positionable between an extended, interlocking position and a collapsed, compact position. When in the collapsed, compact position, the tubular segments 20 form a substantially small, lightweight, and easily portable bundle 12, shown in FIG. 5. This small bundle 12 can be conveniently stored and carried by a diver 70 during normal diving activities, as illustrated in FIG. 2, and taken out only when needed for surfacing. When the tubular segments 20 are positioned in the extended, interlocking position, they form a substantially elongate, easily carryable shaft 14. The shaft 14 is structured so that it can be held by one hand of a diver 70 and extended above the surface of the water 80, as best seen in FIG. 1. Also if made of a buoyant material, the diver 70 does not have to support the entire weight of the extended shaft 14. The shaft 14 is sized so as to not be so long that a diver 70 will have difficulty in manipulating and stabilizing the shaft 14, but rather only long enough so that the diver 70 can extend the distal segment 21 of the shaft through the surface of the water 80 prior to arriving at the surface of the water 80. Particularly, although a diver 70 can view the surface of the water 80 immediately around the area where they are swimming, as the diver 70 approaches the surface 80, the area of visibility with regard to boats 90 and other vehicles in the water is minimized. For this reason, the distal segment 21 is extended through the water surface 80 with a warning flag 50, preferably in the form of a diver down flag, fixedly secured thereto. Since the diver 70 is still beneath the water's surface 80 when signalling is first commenced, boats 90 will be able to avoid the area since they know it will soon contain a diver 70, and if the proximity of the boat 90 makes it too late to veer off course, the diver 70 will still be sufficiently beneath the surface of the water 80 to avoid serious contact.

The personal dive flag 10 also includes automatic extension means. The automatic extension means are adapted to rapidly and independently position the tubular segments 20 in the extended interlocking position from the collapsed, compact position. This positioning will not occur until the diver 70 wants and initiates the extension, but when so initiated will automatically extend the shaft 14 for immediate use by the diver 70. In the preferred embodiment, each of the tubular segments 20 includes a hollow center wherethrough an elastic, or bungee-type chord 30 is threaded. The elastic chord 30 functions as the automatic extension means and is threaded through the hollow center of all of the tubular segments 20 in an extended, stretched position. Stopper means are included at opposite ends of the elastic chord 30 so as to prevent the elastic chord 30 from being pulled out from the tubular segments 20. Preferably, the stopper means include merely a knot 31 and 32 in each end of the elastic chord 30. Since the chord 30 is threaded in an extended position, the natural biasing forces of the elastic chord 30 will tend to make it compressed. Utilizing this force, the elastic chord 30 will urge all of the tubular segments 20 into the extended, interlocking position if the tubular segments 20 are not affirmatively retained in the bundle 12 of the compact, collapsed position. Accordingly, retaining means are included to hold the tubular segments 20 in the bundle 12 of the compact, collapsed position until release is desired by the diver 70. In the preferred embodiment, the retaining means are part of the diver down flag 50. In this embodiment, the elastic chord 30 is folded between each of the tubular segments 20, as seen in FIG. 4, so as to form a small bundle 12 of all of the tubular segments 20. The diver down flag 50, which is fixedly secured to the distal segment 21, is then wrapped around the bundle 12 of tubular segments 20 and raw releasable fasteners, preferably in the form of hook and loop fastener pads 51 and 52 positioned on opposite sides of the diver down flag 50, in spaced apart relation from one another, are utilized to removably fasten the diver down flag 50 around the tubular segments. When the diver 70 wishes to initiate extension by the automatic extension means, the diver 70 must merely pull apart the hook and loop fastener pads 51 and 52 and allow the elastic chord 30 to automatically interlock all of the tubular segments 20 to form the shaft 14. In order to assure that the diver 70 has a good hold upon the personal dive flag 10, handle means are disposed at the proximal segment. Preferably, the handle means includes a loop 35 of the elastic chord 30 extending beyond the knot 31 placed in the elastic chord 30.

In a second embodiment, all of the tubular segments 20 are sized and configured to be concentrically disposed within one another, as shown in FIG. 6. The proximal segment 22 includes the largest inner diameter and is adapted to contain the middle segments and the distal segment 21 all concentrically within its hollow center surface. Accordingly, extension of the tubular segments 20 into the elongate shaft 14 will have a telescoping effect. In this embodiment, the automatic extension means includes spring means positioned within the proximal segment. Preferably, the spring means includes a coiled spring 28 positioned within the proximal segment 22 and adapted to extend all of the tubular segments 20 upon demand so as to form the shaft 14 of the extended, interlocking position. Retaining means preferably in the form of a release button or knob 37 are included to maintain the tubular segments 20 in the bundle of the collapsible compact position. The retaining means maintain all of the tubular segments 20 concentrically positioned within the proximal segment and maintains the spring 28 in a compressed condition until released, the release resulting in immediate and automatic extension of the shaft 14 of the extended interlocking position. The release button or knob 37 actuates and releases a retaining pin 38 disposed in the proximal segment 22 only upon demand by the diver 70. Also, once extended, the tubular segments 20 are matingly locked in place by corresponding tongue and groove elements 26 and 27 or like means disposed on interior and exterior surfaces of each of the tubular segments 20.

Now that the invention has been described,

What is claimed is:

1. An extendable, personal dive flag comprising:

a plurality of tubular segments, each of said tubular segments being structured and disposed to be matingly engaged with one another, said tubular segments including a proximal segment, a distal segment, and a plurality of middle segments, and being positionable between an extended, interlocking position and a collapsed, compact position, said tubular segments being in a substantially small, lightweight, and easily portable bundle when in said collapsed, compact position so as to be conveniently carried by a diver, said tubular segments forming a substantially elongate, easily carryable shaft when in said extended interlocking position so as to enable the diver to swim towards a water's surface while holding said shaft and to extend said distal segment of said shaft through the water's surface before the diver reaches the water's surface, a warning flag fixedly secured to said distal segment, automatic extension means structured and disposed to, upon demand and initiation by the diver, rapidly and independently position said tubular segments in said extended, interlocking position from said collapsed, compact position, said automatic extension means including an elastic chord threaded through a hollow center of each of said tubular segments, stopping means disposed at opposite ends of said elastic chord to prevent said elastic chord from being pulled out from said tubular segments, said elastic chord being structured and disposed to urge said tubular segments into said extended, interlocking position when said tubular segments are not affirmatively retained in said bundle of said compact, collapsed positon, and quick release retaining means structured and disposed to removably maintain said warning flag disposed about said tubular segments and hold said tubular segments in said bundle of said compressed, collapsed position until released to initiate automatic extension by said automatic extension means.

2. An extendable, personal dive flag comprising:

a plurality of tubular segments, each of said tubular segments being structured and disposed to be matingly engaged with one another, said tubular segments including a proximal segment, a distal segment, and a plurality of middle segments, and being positionable between an extended, interlocking position and a collapsed, compact position, said tubular segments being in a substantially small, lightweight, and easily portable bundle when said collapsed, compact position so as to be conveniently carried by a diver, said tubular segments forming a substantially elongate, easily carryable shaft when in said extended, interlocking position so as to enable the diver to swim towards a water's surface while holding said shaft and to extend said distal segment of said shaft through the water's surface before the diver reaches the water's surface, a warning flag fixedly secured to said distal segment, automatic extension means structured and disposed to, upon demand and initiation by the diver, rapidly and independently position said tubular segments in said extended, interlocking position from said collapsed, compact position, said automatic extension means including an elastic chord threaded through a hollow center of each of said tubular segments, stopping means disposed at opposite ends of said elastic chord to prevent said elastic chord from being pulled out from said tubular segments, said elastic chord being structured and disposed to urge said tubular segments into said extended, interlocking position when said tubular segments are not affirmatively retained in said bundle of said compact, collapsed position, quick release retaining means structured and disposed to maintain said tubular segments in said bundle of said compressed, collapsed position until released to initiate automatic extension by said automatic extension means, and handle means disposed at said proximal segment so as to facilitate holding of said tubular segments by the diver.

3. An extendable, personal dive flag comprising:

a plurality of tubular segments, each of said tubular segments being structured and disposed to be matingly engaged with one another, said tubular segments including a proximal segment, a distal segment, and a plurality of middle segments, and being positionable between an extended, interlocking position and a collapsed, compact position, said tubular segments being in a substantially small, lightweight, and easily portable bundle when in said collapsed, compact position so as to be conveniently carried by a diver, said tubular segments forming a substantially elongate, easily carryable shaft when in said extended, interlocking position so as to enable the diver to swim towards a water's surface while holding said shaft and to extend said distal segment of said shaft through the water's surface before the diver reaches the water's surface, a warning flag fixedly secured to said distal segment, automatic extension means structured and disposed to, upon demand and initiation by the diver, rapidly and independently position said tubular segments in said extended, interlocking position from said collapsed, compact position, said automatic extension means including an elastic chord threaded through a hollow center of each of said tubular segments, stopping means disposed at opposite ends of said elastic chord to present said elastic chord from being pulled out from said tubular segments, said elastic chord being structured and disposed to urge said tubular segments into said extended, interlocking position when said tubular segments are not affirmatively retained in said bundle of said compact, collapsed position, quick release retaining means structured and disposed to maintain said tubular segments in said bundle of said compressed, collapsed position until released to initiate automatic extension by said automatic extension means, and said quick release retaining means including releasable fasteners disposed on said warning flag, so as to enable said warning flag to be wrapped around said bundle of said tubular segments and fastened to removably secure and contain said tubular segments therein.

4. An extendable, personal dive flag as recited in claim 2 wherein said retaining means includes releasable fasteners disposed on opposite sides of said warning flag, in spaced apart relation from one another, so as to enable said warning flag to be wrapped around said bundle of said tubular segments and fastened to removably secure and contain said tubular segments therein.

5. An extendable, personal dive flag as recited in claim 3 further including handle means disposed at said proximal segment so as to facilitate holding of said tubular segments by the diver.

* * * * *